US008807263B2

(12) United States Patent
Caillieret et al.

(10) Patent No.: US 8,807,263 B2
(45) Date of Patent: Aug. 19, 2014

(54) EXCAVATOR AND PROCESS FOR ASSEMBLING OR DISSASSEMBLING SUCH EXCAVATOR

(75) Inventors: Roger Caillieret, Brens (FR); Gregory Arnal, Avressieux (FR)

(73) Assignee: Volvo Compact Equipment SAS, Belley (FR)

( * ) Notice: Subject to any disclaimer, the term of this patent is extended or adjusted under 35 U.S.C. 154(b) by 43 days.

(21) Appl. No.: 13/640,571

(22) PCT Filed: Apr. 12, 2010

(86) PCT No.: PCT/IB2010/001066

§ 371 (c)(1),
(2), (4) Date: Oct. 11, 2012

(87) PCT Pub. No.: WO2011/128719

PCT Pub. Date: Oct. 20, 2011

(65) Prior Publication Data

US 2013/0025170 A1 Jan. 31, 2013

(51) Int. Cl.

| | |
|---|---|
| ***B60K 17/00*** | (2006.01) |
| ***E02F 9/22*** | (2006.01) |
| ***E02F 9/08*** | (2006.01) |
| ***E02F 9/20*** | (2006.01) |

(52) U.S. Cl.

CPC ..... *E02F 9/08* (2013.01); *E02F 9/2271* (2013.01); *E02F 9/2285* (2013.01); *E02F 9/2275* (2013.01); *E02F 9/2004* (2013.01); *E02F 9/2267* (2013.01)

USPC ..... 180/305; 180/306; 180/307

(58) Field of Classification Search

CPC ..... B60K 17/28; B60K 25/06; B60K 17/10; B60K 17/105; B60K 17/00

USPC ..... 180/305, 306, 307, 53.1, 53.4

See application file for complete search history.

(56) References Cited

U.S. PATENT DOCUMENTS

| | | | | |
|---|---|---|---|---|
| 7,684,917 | B2 * | 3/2010 | Furuno et al. | 701/50 |
| 7,975,475 | B2 * | 7/2011 | Ramun | 60/427 |
| 8,204,655 | B2 * | 6/2012 | Tomita et al. | 701/50 |
| 2003/0084782 | A1 | 5/2003 | Kaneda et al. | |
| 2007/0213855 | A1 * | 9/2007 | Furuno et al. | 700/83 |

(Continued)

FOREIGN PATENT DOCUMENTS

| | | |
|---|---|---|
| EP | 1589153 A1 | 10/2005 |
| EP | 1997965 A1 | 12/2008 |

(Continued)

OTHER PUBLICATIONS

Internationa. Search Report (Jan. 24, 2011) for corresponding international application No. PCT/IB2010/001066.

*Primary Examiner* — Hau Phan
(74) *Attorney, Agent, or Firm* — WRB-IP LLP

(57) ABSTRACT

An excavator includes a frame, and a platform on top of the frame. A hydraulic distribution system is received on top of the frame but below the platform. A pilot valve unit is at least partly received on top of the platform. The platform includes a dedicated hole capable of receiving therethrough at least that part of the pilot valve unit which is received on top of the platform. The pilot valve unit is fixed, directly or indirectly, on the platform. The pilot valve unit can be mounted from below the platform, through the dedicated hole, and is fixed on the platform from above the platform.

15 Claims, 5 Drawing Sheets

(56) References Cited

U.S. PATENT DOCUMENTS

| | | | | |
|---|---|---|---|---|
| 2011/0173964 | A1* | 7/2011 | Takahashi et al. | 60/451 |
| 2012/0067432 | A1* | 3/2012 | Vigholm et al. | 137/14 |
| 2012/0130576 | A1* | 5/2012 | Sugiyama et al. | 701/22 |

FOREIGN PATENT DOCUMENTS

| | | | |
|---|---|---|---|
| JP | H0427281 | U | 3/1992 |
| JP | 2003020682 | A | 1/2003 |
| JP | 2007047865 | A | 2/2007 |

* cited by examiner

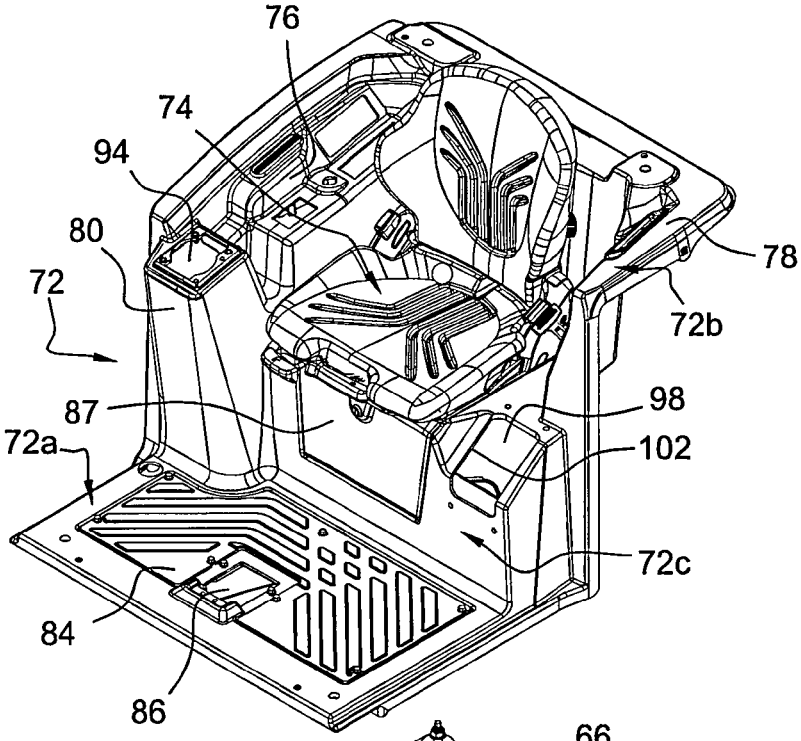
Fig. 3
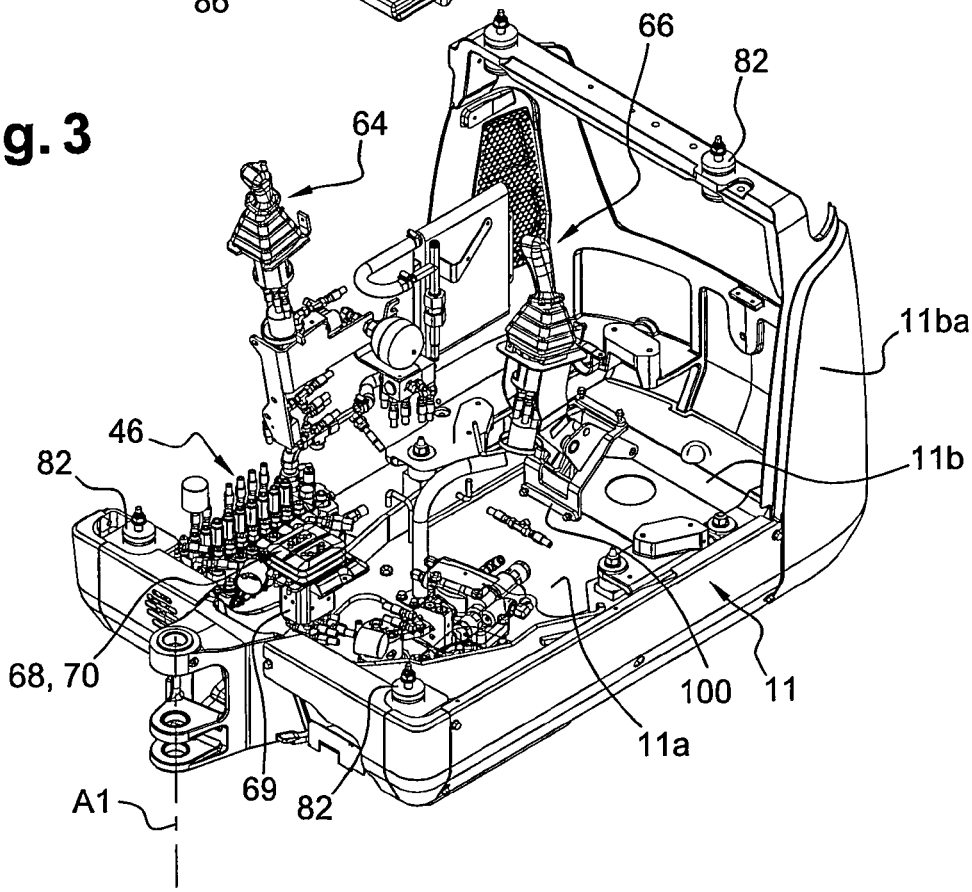

EXCAVATOR AND PROCESS FOR ASSEMBLING OR DISSASSEMBLING SUCH EXCAVATOR

BACKGROUND AND SUMMARY

The invention relates to the field hydraulic excavators or mini-excavators having hydraulically operated earth-moving tools.

On FIG. 1 is depicted a conventional excavator 10. It comprises an upper frame 11 carrying the excavator's superstructure 12 which comprises an operator station which can be enclosed in a closed cabin 14 and an engine arrangement which may be located in a rearwardly located engine compartment 16. Some excavators do not have such closed cabin and have an operator station which can be totally open or only covered by a canopy. The upper frame carries the machine's main work equipment: a digging assembly 18. Typically, the digging assembly 18 can have a boom 20 which is pivotably connected around a horizontal axis on the upper frame. The boom 20 can be lowered and lifted vertically by a boom cylinder 22. At the free end of the boom 20, an arm 24 may be pivotably connected around another horizontal axis, and it can be lowered and lifted by an arm cylinder 26. At the free end of the arm 24, a working tool, such as bucket 28, is pivotably connected around another horizontal axis and it can be pivoted relative to the arm 24 by a bucket cylinder 30. The digging assembly 18 as a whole can usually be rotated with respect to the upper frame around a vertical axis A1, thanks to a non represented hydraulic cylinder.

The work equipment of such excavators is most often controlled through one or several manually operated hydraulic pilot valve units. For the digging equipment 18 of an excavator, it is most often provided two hydraulic joystick controllers which the operator can operate by hand. These controllers are located preferably on both sides of an operator seat, near the front end of the seat. In some machines, such controllers are arranged on the seat armrests, in a more affordable design, the controllers can be arranged directly on a platform which forms the supporting structure of the operator station.

A lower frame carries the undercarriage 32 of the machine 10, which comprises mainly the drive train 34 of the machine. In the example shown, the drive train is in the form of a pair of endless tracks but it could also be made of a set of wheels. It is common for such a construction machine to be designed as a skid steer machine. Is such a case, the drive train comprises at least two propulsion units, one dedicated to the right side of the machine and the other one dedicated to the left side of the machine. Each propulsion unit therefore drives one endless track (left or right) or a set of synchronous wheels located on one side of the machine. In many cases, the propulsion units are hydraulically powered, and they are piloted through a dedicated hydraulic pilot circuit. The controllers comprise each at least one manually operated proportional valve which provides oil pressure to one side or the other of the propulsion unit's power hydraulic circuit, at a varying pressure and/or flow rate. In a conventional design, the manually operated valves for controlling the propulsion units are arranged at the floor level of the operator station, right in front of the driver, and can be operated manually by hand, through a substantially vertically extending lever portion of the pilot valve unit and/or by foot through a pedal portion. A single 4-axis controller can also be used for independently controlling the two propulsion units.

In the example shown, the undercarriage 32 also comprises a working tool which is for example in the form of a front blade 36. For this blade to be perfectly convenient, it may be desirable that it not only is capable of being lowered and lifted with respect to the undercarriage but also that it can be rotated around a horizontal axis and/or around a vertical axis. As it is well-known, the superstructure 12 of the machine can swivel around a vertical axis with respect to the undercarriage thanks to a suitable mechanical link 15 between the upper frame and the lower frame, with the possibility of both frames rotating with respect to each other around a vertical axis. In many cases, the superstructure can swivel 360 degrees, thanks to a swivel joint 15.

Most construction equipment machines use a hydraulic pressure system to operate the various working tools 28, 36 carried by the machine, as well as to operate the drive train 34. The hydraulic pressure system comprises at least one hydraulic pump which feeds pressurized fluid to various actuators through hydraulic circuits comprising hydraulic lines, distributors, valves, etc. The hydraulic pump is driven by the engine arrangement, which can comprise a Diesel engine and/or an electric motor.

The majority of parts of the hydraulic pressure system are usually located on the upper frame of the machine. On the other hand, some of the tools carried by the machine may be located on the lower frame, such as the blade 36 mentioned above, not to mention the fact that the drive train, carried of course by the lower frame, usually comprises two hydraulic motors and, possibly, a hydraulic actuated gearbox.

Therefore, the machine is equipped with a rotary joint which provides hydraulic passages which permit the hydraulic lines to pass from the upper frame to the lower frame without being interrupted and without impeding the free swiveling of the two frames. Therefore, the rotary joint may have an upper part connected to the upper frame and a lower part connected to the lower frame. The upper and lower parts of the rotary joint have for example respective annular contact surfaces bearing one against the other, and at least one of the annular contact surfaces comprises an annular groove which is closed by either a corresponding annular groove on the other contact surface, or simply closed by that other contact surface. The groove(s) define an annular fluid flow path at the interface between the parts of the rotary joint. An upper portion of a hydraulic line (for example a hose or a pipe) is connected to the upper part of the rotary joint while a lower portion of the hydraulic line (made for example of another hose or pipe) is connected to the lower part of the rotary joint, both being fluidly connected to the annular groove. With this construction the upper and lower portions of the hydraulic line are fluidly connected one to the other irrespective of the angular position of the two parts of the rotary joint.

Conventionally, the operator station comprises a platform which is arranged on top of the frame 11. The platform is preferably attached to the frame through suspension systems. The platform, which can be made of one or several parts, typically forms the floor of the operator station and can also form a seat support, side consoles and even controller consoles. Therefore, the platform is not necessarily flat. Typically, a good portion of the hydraulic circuit of the machine is located on top of the frame 11, but below the platform. On the other hand, the various hydraulic pilot controllers are obviously at least partly received on top of the platform so as to be accessible to the driver.

Up to now such controllers are simply fixed on top of the platform in some way and are then connected to the rest of the hydraulic circuit through flexible pipes. In an assembling process, most of the hydraulic circuit is first mounted on the frame, and the platform is subsequently attached on top of the frame. The controllers are then subsequently attached on the platform, or may have been attached to the platform prior to assembly on the frame. In both cases, this means that the connection between the controllers and the rest of the hydraulic circuit has to be performed after the platform has been assembled on top of the frame. This has well known disadvantages. For example, it is frequently quite complicated to perform such connection of the controllers, because of lack of accessibility. Also, such assembly process makes it impossible to test the hydraulic pilot circuit, for example for leaks, before the assembly of the platform. If an hydraulic component is found to be defective, it may be necessary to disassemble the platform to provide some remedy, but such disassembly of the platform necessitates a prior disconnection of the pilot circuit from the hydraulic distribution system so that it is not any more possible to operate the hydraulic circuit for diagnosing purposes.

Therefore, the invention has the goal to provide a new design of an excavator which allows an easier assembly and disassembly of the hydraulic circuit assembly. The invention also has the goal of allowing a new assembling process and a new disassembling process for an excavator.

In view of this goal, the invention provides for an excavator comprising at least:

a frame.

a platform on top of the frame, a hydraulic circuit assembly including at least:

a main pump delivering pressurized fluid a number of hydraulic actuators a hydraulic distribution system for distributing pressurized fluid from the main pump to the various hydraulic actuators according at least to a hydraulic pilot circuit comprising at least one manually operated hydraulic pilot valve unit connected to the hydraulic distribution device, and wherein:

the hydraulic distribution system is received on top of the frame but below the platform, while the pilot valve unit is at least partly received on top of the platform, the pilot valve unit is hydraulically connected to the hydraulic distribution system subassembly by hydraulic pipes;

the platform comprises a dedicated hole capable of receiving therethrough at least that pan of the pilot valve unit which is received on top of the platform;

the pilot valve unit is fixed, directly or indirectly, on the platform such that the unit, or the hydraulic pipes extend through the hole;

characterized in that the pilot valve unit can be mounted from below the platform, through the dedicated hole, and is fixed on the platform from above the platform.

The invention also provides for a process for assembling such an excavator, characterized, in that the process includes at least:

the step of preassembling the hydraulic distribution system on the frame, and of hydraulically connecting the pilot valve unit to the hydraulic distribution stem so that no further hydraulic connection is needed;

the subsequent step of placing the platform on top of the frame, including passing at least part of the pilot valve unit through a dedicated hole in a platform.

the subsequent step of fixing, from above the platform, the pilot valve unit directly or indirectly on the platform.

The invention also provides for a process for disassembling the platform from the frame of such an excavator, characterized in that the process includes at least the step of releasing, from above the platform, the pilot valve writ from the platform;

the subsequent step of removing the platform from the frame, including passing at least part of the pilot valve unit through a dedicated hole in a platform without necessarily disconnecting the pilot valve unit from the hydraulic distribution system.

DESCRIPTION OF FIGURES

Further features of the invention will become apparent from the following detailed description, with reference to the annexed drawings in which:

FIG. 3 is an exploded perspective view of the upper frame of the platform, and of some hydraulic components of an excavator;

DETAILED DESCRIPTION

Figure 1:
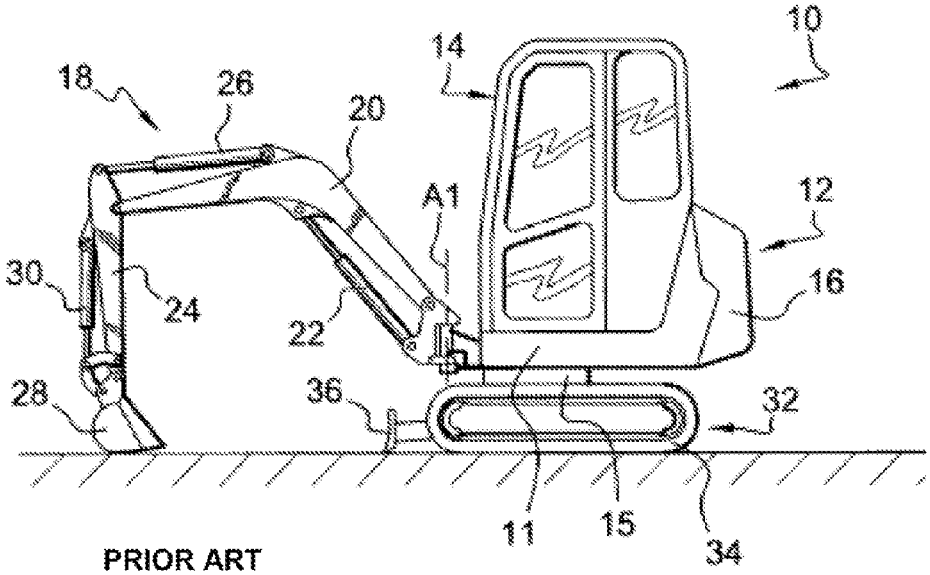
FIG. 1 is a side view of an excavator.
Figure 2:
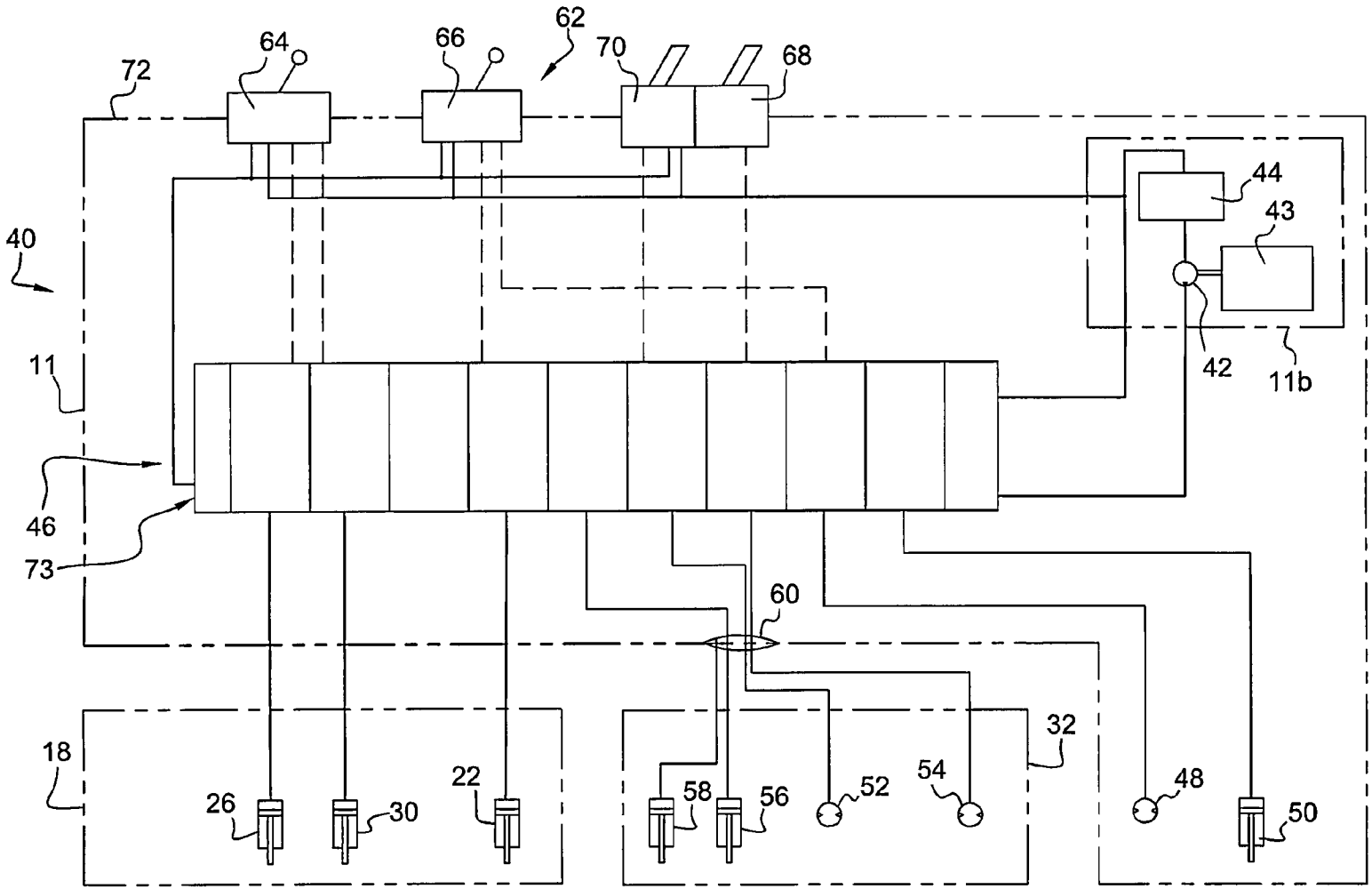
FIG. 2 is a schematic view of the main components of a hydraulic circuit assembly of an excavator.

On FIG. 2 are represented most components of a hydraulic circuit assembly 40 for an excavator 10. This circuit assembly is conventional and well known to the skilled man in the art. In FIG. 2, hydraulic connections are symbolically represented and the number of pipes necessary for such connections is not shown.

The circuit assembly 40 comprises a main pump 42, which is driven by the engine arrangement, such as a Diesel engine 43, and which takes oil from a hydraulic oil tank 44 to pressurize it and deliver it to a hydraulic distribution system 46. Various additional components such as oil filters, oil coolers, pressure regulators, safety valves may be provided in a conventional way. The hydraulic distribution system 46 may be connected to the hydraulic oil tank 44 by a main return line 45.

The hydraulic distribution system 46 distributes the pressurized fluid from the main pump to various hydraulic actuators. These actuators may include the cylinders 22, 26, 30 of the digging assembly 18, which are carried by the digging assembly 18. These actuators may comprise actuators carried by the frame 11 such as a swiveling motor 48 for controlling the movement of the upper frame 11 with respect to the lower frame around a vertical axis, or such as a cylinder 50 for controlling the orientation of the digging assembly 18 with respect to the frame 11 around axis A1. These actuators may also be carried by the lower frame, such as left and right hydraulic propulsion motors 52, 54 or such as cylinders 56, 58 for controlling the front blade 36, and in such case the actuators are connected to the hydraulic distribution system 46 through a swivel joint 60.

For most of these functions, the hydraulic distribution system 46 operates under the control of a hydraulic pilot circuit 62. The pilot circuit. 62 comprises at least one manually operated hydraulic pilot valve unit connected to the hydraulic distribution device. In the shown example, the pilot circuit 62 comprises two conventional 4-axis joystick controllers 64, 66 for controlling the digging implement 18 and the swiveling motor 48, and comprises two pedal controllers 68, 70 each of the propulsion motors. In those examples, the respective joystick and the respective pedal form an operator interface component of the valve unit which the operator can manipulate, this operator interface component being movable with respect to a valve unit body. The other actuators are for example controlled by other non shown controllers which are not necessarily hydraulic but which can be electric or purely mechanical. Each hydraulic pilot valve unit receives pressurized fluid from a source of pilot pressure, which can be in the form of a pressure reducer forming part of the hydraulic distributing system 46. The pilot pressure is modulated by the hand operated valve unit 64, 66, 68, 70 to act proportionally on the distributing, system 46 which will deliver a corresponding fraction of the power pressure delivered by the pump 42 to the corresponding actuators 22, 26, 30, 50, 48, 52, 54, 56, 58. Hydraulic pilot valve units can be opposed to mechanical controllers, where the controller acts directly mechanically on a component of the distribution system, such as a mechanical valve, and from electric pilot controllers where the controller delivers an electric signal for controlling a component of a hydraulic distribution system, for example a solenoid valve. Hydraulic, pilot controllers are usually a form of manually operated hydraulic valve to control the pilot pressure acting on a corresponding component of the hydraulic distribution system.

The hydraulic distribution system 46 can comprise a conventional distributor formed of a plurality of stacked hydraulic, valves elements, the valve elements being hydraulically controlled by the pilot pressure. Each valve element can feed one or several actuators with the required operating pressure to perform the required displacement, at the required speed and/or with the required force.

On FIG. 3 is represented only the upper frame 11 of the excavator 10, the platform 72, part of the hydraulic distribution system, and part of the hydraulic pilot circuit 62. In the figures, the front of the machine is towards the left, the rear towards the right, while the left and right sides are respectively to the front and to the rear of the drawing. The top and bottom directions for the machine are the top and bottom directions on the drawings.

The frame 11, which is the upper frame, substantially carries all the superstructure of the machine. It can be made of one part, extending substantially along the whole length and width of the superstructure, or it can be made of several parts. The frame 11 carries directly or indirectly the engine arrangement in a rear or side part, the digging equipment 18 in a front part, the swivel joint in a central part, the hydraulic distribution system 46, and the platform 72 supporting the operator station. The frame 11 can be made in cast metal and/or by fabrication. In the example shown, the frame comprises a main portion 11*a* covering substantially the front and central parts of the frame, and a rear portion 11*b*. Advantageously, the rear portion 11*b* may can the engine arrangement, including for example the engine cooling system, the engine air intake system and the engine exhaust system, the main hydraulic pump 42, the hydraulic tank 44, and other hydraulic, components such as oil filters and coolers or pressure or flow regulators. This rear portion 11*b* of the frame 11 can be made by casting and can include a counterweight portion 11*ba* which forms the machine main counterweight. It is worth noting that all these items can be pre-assembled and mounted on the rear portion of the frame before attaching this rear portion 11*b* to the main portion 11*a*.

The platform 72 forms substantially the lower surface of the operator station of the excavator. In a compact excavator, i.e. a machine having a total weight less than 8 tons, the platform 72 may stretch over substantially the whole surface of the upper frame 11. In such a case, and especially when the engine arrangement is located to the rear of the frame, the platform may exhibit the stepped shape as shown on FIG. 3, with when viewed from the side, a lower front section 72*a*, substantially horizontal for receiving the feet of the operator, an elevated rear section 72*b*, which may then be located at least partially over the engine compartment, and a substantially vertical central section 72*c* joining the two portions. The rear section 72*b* of the platform may form a support for an operator's seat 74, and may also form side consoles 76, 78, 80 on both sides of the seat support for receiving various controls, displays or other equipment of the operator station. The rear and central sections of the platform separate the operator station from the engine compartment. The platform 72 can be that of an open operating station. It can also be equipped with a canopy, or it could be integrated in a closed cabin structure.

The platform 72 is to be attached, directly or indirectly, to the frame 11, on top of the frame, preferably through suspension systems 82 for isolating, the operator station from the machine vibrations.

In the following, when discussing "bottom" or "downwardly facing" surfaces, of the platform, it will be refereed to surfaces of the platform which are generally turned, toward the frame 11, where "top" or "downwardly facing" surfaces refer to surfaces which are generally turned away from the frame. This will apply for example to surfaces such as those of the vertical section 72*c*, where the "top" surfaces are in fact facing the front the machine and "bottom" surfaces are turned towards the rear of the machine.

The platform 72 may be made of several parts structurally fixed one to the other. In the shown embodiment, the platform is advantageously made substantially of one single piece of fiber-reinforced plastic material forming the front, the rear and the central vertical sections of the platform. Nevertheless, the front section 72*a* exhibits a large aperture which is closed by a removable cover 84 in order to give access to the space below the platform 72 when the platform is attached to the frame 11, for example for servicing purposes. The platform 72 is advantageously made by sheet molding and therefore exhibits shaped portions forming the seat support. In this embodiment, the platform exhibits a right console portion 80 for holding a right joystick controller 64, the console portion 80 being such that the controller 64 is located ideally longitudinally just in front of the seat support portion, just on its right, at a convenient height for the controller 64 to be comfortably manipulated by a seated operator. The platform 72 may also comprise an integrally formed storage compartment, or niche, formed under the seat support portion, and opened towards the front in the vertical joining portion. The front opening of the storage compartment is here shown to be closed by an articulated lid 87.

Figure 4:
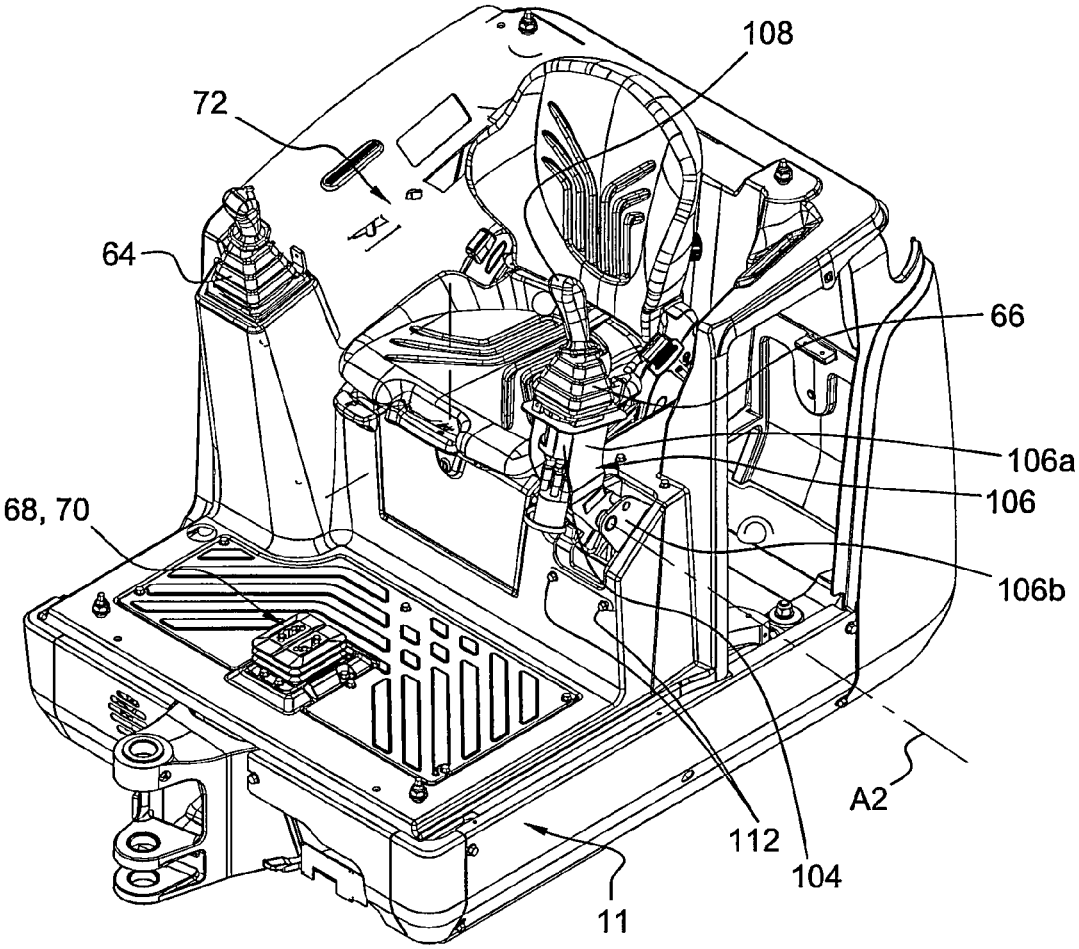
FIG. 4 is a perspective view of the same elements as those of FIG. 3, after assembly.

As can be seen from FIGS. 3 and 4, when the platform 72 is attached to the frame 11, a volume is delimited between the frame and the platform. The rear part of this volume is the engine compartment. The front part of this volume, below the front section 72*a* of the platform 72, shows a reduced height but may nevertheless accommodate a number of components. The front part of the volume is not necessarily separated from the engine compartment, although a separation wall can be provided. As cited above, a number of components of the hydraulic circuit 40 are to be received in the engine compartment and are affixed to the frame 11 here more precisely by being mounted on the rear portion of the frame. Other components of the hydraulic circuit can be received in the front part of the volume between the platform and the frame. In the shown embodiment, at least the hydraulic distribution system 46 is received on top of the frame, but below the platform 72, in the front part of this volume. More precisely, the hydraulic distribution system 46 is fixed on the top surface of the frame, rather than being fixed to a bottom surface of the platform.

On the other hand, the pilot valve units 64, 66, 68, 70 need to be at least partly received on top of the platform 72, while nevertheless being connected to the distribution system 46 by suitable pipes, preferably flexible pipes although rigid pipes could also be used. The pipes have not been shown on the drawings.

More precisely, it is necessary for the operator interface components of such pilot valve units to be accessible to the operator, and, therefore, those interface components have to be located on top of the platform. The pilot valve units are to be fixed on the platform.

The pedal controllers 68, 70, which the driver will manipulate with his feet (although upwardly extending levers could be provided additionally or alternatively to the pedals to allow practical hand operation), are located centrally near the front edge of the platform. Conventionally, the pedals, which are not actually shown, are to be situated, in use, just above the level of the front section 72*a* of the platform which forms a floor portion of the operator station. On the other hand, a valve body of the pilot valve unit, which is here a common body 69 for the two pilot valves 68, 70, is preferably located at the level of the platform or preferably below the platform. Therefore the platform is provided with a pedal controller dedicated hole 86 and in use, the pedal controller extends through the dedicated hole, with its valve body portion 69 at least partly received under the platform level and the operator interface, i.e. the pedals in themselves, extending above said platform level. Here, the platform level has to be interpreted as the level of the part of the surface to which the pilot valve unit is effectively fixed.

According to a feature of the invention, the pilot valve units 68, 70 can be mounted from below the platform. In this example, this has the consequence that the dedicated hole 86 in the platform needs to be of sufficient size to allow the passage therethrough of at least that part of the pilot valves unit which are to be received on top of the platform.

On the other hand, the pedal controllers are fixed on the platform 72 from above the platform, thereby ensuring that there is no need to have access from under the platform to ensure proper fixing of the controllers.

Figure 5:
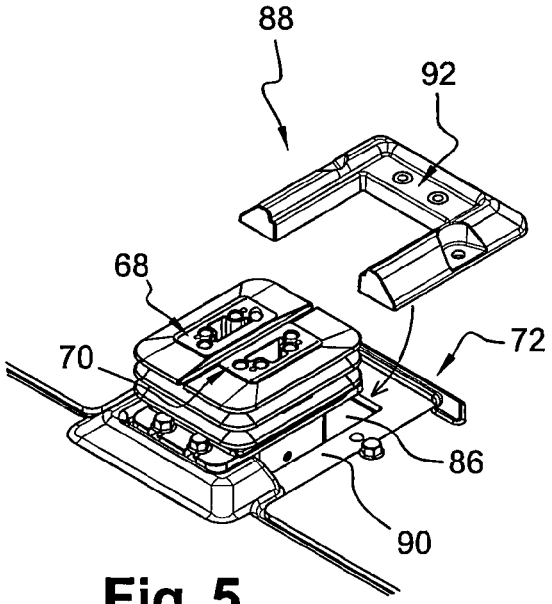
FIGS. 5 and 6 show details of the how the pilot valve units may be fixed on the platform from above.

As can be seen on FIG. 5, the pedal controllers are blocked downwardly with respect to the platform by a key part 88 which can be inserted from above the platform between a downwardly facing surface of the valve units and an upwardly facing surface 90 of the platform. In the shown example the key part 88 is substantially U shaped in a horizontal plane, so as to be inserted along a horizontal direction substantially perpendicular to the vertical axis of the dedicated hole 86. In this embodiment, the downwardly facing surface of the valve units 68, 70 is a rear edge surface, corresponding in shape and size to the top surface 92 of the key part, formed on a collar at the top end of their common valve body 69. The upwardly facing surface 90 of the platform is on the edge of the dedicated hole 86. The size and shape of the key pan 88 is such that it cannot go downwardly through the dedicated hole in the platform, but such that it defines a reduced dimension aperture of sufficient size between the two branches of the U to allow the passage of the part of the valve body just under the downwardly facing surface of the valve body.

In this example, the valve unit body 69 is also in direct abutment, by a front part, against a top surface on the front edge of the hole 86.

In this example, the pilot valve unit is fixed on the key part 88, for example by a first series of screws, and the key pan 88 is independently fixed on the platform, for example by a second series of screws. Of course, such screws need to be oriented with their heads upwards, so as to be accessible from the top of the platform 72. A second series of screws, also accessible from the top, fixes the front part of the valve body directly on the platform.

In a non represented embodiment, it could be provided that the pilot valve unit is fixed by fasteners which extend through the unit, through the key part and through the platform, so as to be jointly fixed. In such a case, the fasteners could be screws having their heads lying directly or indirectly on an upper facing surface of the unit.

Figure 6:
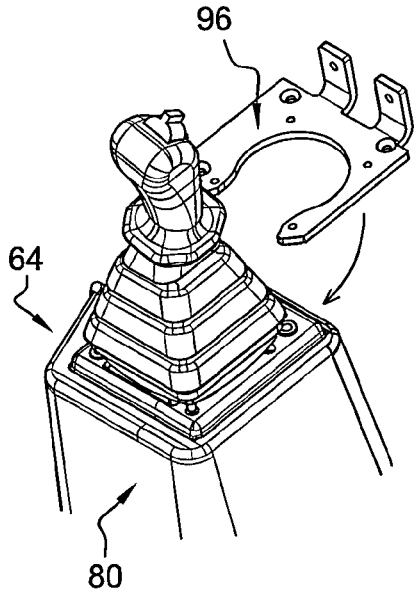

As shown on FIG. 6, the right joystick controller 64, which is to be fixed on top of the right console 80, is also mounted from below the platform 72, through a dedicated hole 94 in the platform, and is fixed from above the platform in the same way as the pedal controller, also with the use of a substantially U-shaped key part 96.

The left joystick controller 66 is also mounted from below the platform 72, through a dedicated hole 98 in the platform, and is fixed on the platform from above the platform.

Nevertheless, this left joystick controller 66 is not fixed with the use of a key part. Rather, it will be seen that, in this embodiment, the pilot valve unit 66 comprises an upwardly facing fixing surface 100 which cooperates directly or indirectly with a downwardly facing surface 102 of the platform.

In this embodiment, the pilot valve unit comprises a valve body 104 and a mounting bracket 106. In the depicted embodiment, the bracket is separate from the valve body but is affixed to said valve body. Nevertheless, the mounting bracket could be integral with the valve body. The mounting bracket 106 is in fact an extension of the valve body 104, allowing more freedom in the placement of the operator interface element 108 in the operator station with respect to the location 102 of the fixation of the pilot valve unit to the platform. The separate mounting bracket 106 allows using standard pilot valve units.

Moreover, in the shown embodiment, the mounting, bracket comprises at least two parts 106*a*, 106*b* which may be displaced one with respect to the other, one of the parts 106*a* being affixed to the pilot valve body 104 and the other part being fixed on the platform 72 from above the platform. These two parts 106*a*, 106*b* may for example rotate one with respect to the other around a horizontal transverse axis A2, allowing the pilot valve body 104 to be moved from a use position, shown on the figures, to a retracted, position where the pilot valve unit 66 interferes less for the access of the operator to his seat 74.

As the other controllers, the left joystick controller 66, affixed on its mounting bracket, may be mourned from below the platform, through the dedicated hole 98 in the platform. The lower end of the mounting bracket is equipped with a fixing, collar 100 which abuts against a downwardly facing peripheral surface 102 of the platform which extends along the periphery of the dedicated hole 98. The unit is fixed by screws 112 which extend through the platform and through the fixing collar of the mounting bracket 106, the head of the screws lying directly or indirectly on an upwardly facing, surface of the platform 72.

Of course, the left controller 66 and its mounting bracket 106 could also be fixed on the platform with the use of a key part, as the other controllers. Conversely, all the controllers could be fixed on the platform is a way similar to that of the left controller.

As it appears from the above description, the excavator comprises several manually operated hydraulic pilot valve units 64, 66, 68, 70 which are connected to the hydraulic distribution device 46 and which are least partly received on top of the platform 72, and all of said units can be mounted from below the platform, through a dedicated hole 86, 94, 98 in the platform, and are fixed on the platform from above the platform, meaning that the fixation means are accessible and can be manipulated from above the platform.

Thanks to the design of the excavator 10, an optimized process for assembling and disassembling the excavator can be put in practice.

Regarding the assembly of the excavator, the process can provide the following steps, in that order.

a step of preassembling the hydraulic distribution system 46 on the frame 11, and of hydraulically connecting the pilot valve unit(s) to the hydraulic distribution system so that no further hydraulic connection is needed from the pilot valve units;

a subsequent step of placing the platform 72 on top of the frame 11, including passing at least part of the pilot valve unit(s) through a dedicated hole in the platform.

a subsequent step of fixing, from above the platform, the pilot valve unit(s) directly or indirectly on the platform.

The order of these steps are shown on FIG. 3 where the it can be clearly seen that all the controllers can be hydraulically connected to the hydraulic distribution system before the platform is fixed on the frame, for example with flexible pipes. For example, each 4-axis controller 64, 66 is connected to the distributor by 4 to 6 hydraulic pipes. It can be noted that the connection of the pilot circuit 62 to the distribution system 46 can be performed before or after the distribution system 46 is fixed on the frame 11. If it occurs before, the connection of the pilot circuit 62 can for example be performed at a separate workshop or workstation on the assembly line, which may feature for example special cleanness standards for limiting, the risks of contamination in the pilot circuit. In any case, the fact that the pilot circuit 62 is entirely connected to the distribution system 46 before the platform is mounted on the frame allows this connection to be performed with optimal accessibility and with a possibly to inspect visually the complete system.

Importantly, it has been seen that also the main oil pump 42, the oil cooler, the oil tank are also received on top of the frame 11, below the platform 72. Therefore, it is possible to provide that all, or at least most of, the hydraulic circuit assembly 40 can be assembled, connected, and inspected before the mounting of the platform. It can even provide that the hydraulic, circuit assembly 46 is filled with oil and that it is tested in situ on the frame 11 before the platform is mounted on the frame. This can allow an early detection of malfunction of the hydraulic, circuit assembly 40, such as a detection of leaks, and an early corrective action is made possible while the hydraulic circuit 40 is still easily accessible.

The fact that the controllers are mounted from below the platform 72 and are fixed on the platform from above the platform has the consequence that the following process can be followed for the disassembly of the platform from the frame, which is particularly useful in view of servicing the machine. Such process can advantageously comprise the following steps, in that order:

a step of releasing, from above the platform, the pilot valve unit(s) from the platform 72;

a subsequent step of removing the platform 72 from the frame 11, including passing at least part of the pilot valve unit 64, 66, 68, 70 through a dedicated hole in a platform.

Thanks to the invention, this subsequent step of removing the platform can be performed without disconnecting the pilot circuit from the hydraulic distribution system. Such disconnection is optional, and can be performed at a later step if necessary. If such disconnection is prevented, there is no risk of oil leaking from the system and no need to empty the hydraulic system from its oil, thereby preventing any need of later refilling the hydraulic system. As a consequence the hydraulic system can be kept operational even when the platform 72 has been removed, and can be further inspected to check and possibly repair any malfunction. Of course, the non-disconnection of the hydraulic pilot circuit is even more of interest when the platform needs to be removed for reasons not related to the hydraulic circuit, so that there is no risk of adding subsequent hydraulic problems due only the servicing of other components of the machine.

The invention claimed is:

1. An excavator comprising at least:

a frame, a platform disposed on top of the frame, a hydraulic circuit assembly including at least:

a main pump delivering pressurized fluid, one or more hydraulic actuators, a hydraulic distribution system for distributing pressurized fluid from the main pump to the one or more hydraulic actuators, and a hydraulic pilot circuit comprising at least one manually operated hydraulic pilot valve unit connected to the hydraulic distribution system, and wherein:

the hydraulic distribution system is received on top of the frame but at least partly below the platform, while the pilot valve unit is at least partly disposed on top of the platform, the pilot valve unit is hydraulically connected to components of the hydraulic distribution system by hydraulic pipes;

the platform comprises a dedicated hole through which at least part of the pilot valve unit is adapted to be moved;

the pilot valve unit is fixed, directly or indirectly, on the platform such that the pilot valve unit or the hydraulic pipes extends through the hole;

wherein the pilot valve unit is adapted to be inserted from below the platform, through the dedicated hole, and is fixed on the platform from above the platform.

2. The excavator according to claim 1, wherein the pilot valve unit is blocked downwardly with respect to the platform by a key part which is adapted to be inserted from above the platform between a downwardly facing surface of the unit and an upwardly facing surface of the platform.

3. The excavator according to claim 2, wherein the key part is substantially U shaped so as to be adapted to be inserted along a direction substantially perpendicular to the axis of the dedicated hole.

4. The excavator according to claim 2, wherein the pilot valve unit is fixed on the key part and the key part is independently fixed on the platform.

5. The excavator according to claim 2, wherein the pilot valve unit is fixed by fasteners which extend through the unit, through the key part and through the platform.

6. The excavator according to claim 5, wherein the pilot valve unit is fixed by screws which extend through the unit, through the key part and through the platform, a head of at least one of the screws lying directly or indirectly on an upwardly facing surface of the pilot valve unit.

7. The excavator according to claim 1, wherein the pilot valve unit comprises an upwardly facing fixing surface which cooperates directly or indirectly with a downwardly facing surface of the platform.

8. The excavator according to claim 7, wherein the pilot valve unit is fixed by screws which extend through the pilot valve unit ad the platform, a head of at least one of the screws lying directly or indirectly on an upwardly facing surface of the platform.

9. The excavator according to claim 1, wherein the pilot valve unit is fixed, directly or indirectly, on an edge of the dedicated hole of the platform.

10. The excavator according to claim 1, wherein the pilot valve unit comprises a valve body and a mounting bracket which is integral with the valve body.

11. The excavator according to claim 1, wherein the pilot valve unit comprises a valve body and a mounting bracket which is separate from the valve body but affixed to the valve body.

12. The excavator according to claim 1, wherein the pilot valve unit comprises at least two parts which are adapted to be displaced one with respect to the other, one of the parts being affixed to the pilot valve body and the other part being fixed on the platform from above the platform.

13. The excavator according to claim 1, comprising a plurality of manually operated hydraulic pilot valve units which are connected to the hydraulic distribution device and which are at least partly received on top of the platform, and all of the plurality of manually operated hydraulic pilot valve units are adapted to be inserted from below the platform, through a dedicated hole in the platform, and are fixed on the platform from above the platform.

14. A process for assembling an excavator comprising providing a frame, providing a platform for being disposed on top of the frame, providing a hydraulic circuit assembly including at least:

a main pump for delivering pressurized fluid, one or more hydraulic actuators, hydraulic distribution system for distributing pressurized fluid from the main pump to the one or more hydraulic actuators, and a hydraulic pilot circuit comprising at least one manually operated hydraulic pilot valve unit connected to the hydraulic distribution system, and wherein:

positioning the hydraulic distribution system so that it is disposed on top of the frame but at least partly below the platform, and so that the pilot valve unit is at least partly disposed on top of the platform, hydraulically connecting the pilot valve unit to components of the hydraulic distribution system by hydraulic pipes;

moving at least part of the pilot valve unit through a dedicated hole in the platform from below the platform and fixing the pilot valve unit, directly or indirectly, on the platform so that it is at least partly on top of the platform and such that the pilot valve unit or the hydraulic pipes extends through the hole, preassembling the hydraulic distribution system on the frame, and hydraulically connecting the pilot valve unit to the hydraulic distribution system so that no further hydraulic connection is needed subsequent to the preassembling step;

subsequent to the preassembling step, placing the platform on top of the frame, including passing at least part of the pilot valve unit through a dedicated hole in the platform;

subsequent to the placing step, fixing, from above the platform, the pilot valve unit directly or indirectly on the platform.

15. A process for assembling and disassembling a platform from a frame of an excavator, comprising assembling the platform to the frame by providing a frame, providing a platform for being disposed on top of the frame, providing a hydraulic circuit assembly including at least:

a main pump for delivering pressurized fluid, one or more hydraulic actuators, hydraulic distribution system for distributing pressurized fluid from the main pump to the one or more hydraulic actuators, and a hydraulic pilot circuit comprising at least one manually operated hydraulic pilot valve unit connected to the hydraulic distribution system, and wherein:

positioning the hydraulic distribution system so that it is disposed on to of the frame but at least partly below the platform, and so that the pilot valve unit is at least partly disposed on top of the platform, hydraulically connecting the pilot valve unit to components of the hydraulic distribution system by hydraulic pipes, moving at least part of the pilot valve unit through a dedicated hole in the platform from below the platform and fixing the pilot valve unit, directly or indirectly, on the platform so that it is at least partly on top of the platform and such that the pilot valve unit or the hydraulic pipes extends through the hole, and disassembling the platform from the frame by releasing, from above the platform, the pilot valve unit from the platform; and subsequent from the releasing step, removing the platform from the frame, including passing at least part of the pilot valve unit through the dedicated hole in the platform without disconnecting the pilot valve unit from the hydraulic distribution system.

* * * * *